US006278857B1

(12) United States Patent
Monji et al.

(10) Patent No.: US 6,278,857 B1
(45) Date of Patent: Aug. 21, 2001

(54) COLOR IMAGE FORMING APPARATUS WITH PHASE CORRECTION CONTROLLER

(75) Inventors: Yosuke Monji; Tadayuki Kajiwara; Takami Maeda; Kazunori Nakamura, all of Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/516,395

(22) Filed: Mar. 1, 2000

(30) Foreign Application Priority Data

Mar. 2, 1999 (JP) ..... 11-054114

(51) Int. Cl.[7] ..... G03G 15/01
(52) U.S. Cl. ..... 399/301; 318/85; 347/116
(58) Field of Search ..... 399/299, 300, 399/301; 347/116; 318/85

(56) References Cited

U.S. PATENT DOCUMENTS 4,752,804 * 6/1988 Ohno ..... 399/300
5,995,802 * 11/1999 Mori et al. ..... 399/394
6,049,690 * 4/2000 Nakayasu et al. ..... 399/301

* cited by examiner

*Primary Examiner*—Joan Pendegrass
(74) *Attorney, Agent, or Firm*—Ratner & Prestia

(57) ABSTRACT

An image forming apparatus has a plurality of drive motors for driving a plurality of photosensitive drums independently, a plurality of motor rotation controllers for controlling rotation and driving of the plurality of drive motors independently, a plurality of rotation phase detectors for detecting the rotation phase of each one of the plurality of photosensitive drums, a rotation phase difference calculator for calculating the rotation phase difference of the other photosensitive drums corresponding to the rotation phase of the photosensitive drum for black as the reference, a phase correction setting unit for setting the rotation phase difference in printing operation, and a phase correction controller for correcting rotation phase of the other photosensitive drums on the basis of the calculated rotation phase difference and the set rotation phase difference.

12 Claims, 13 Drawing Sheets

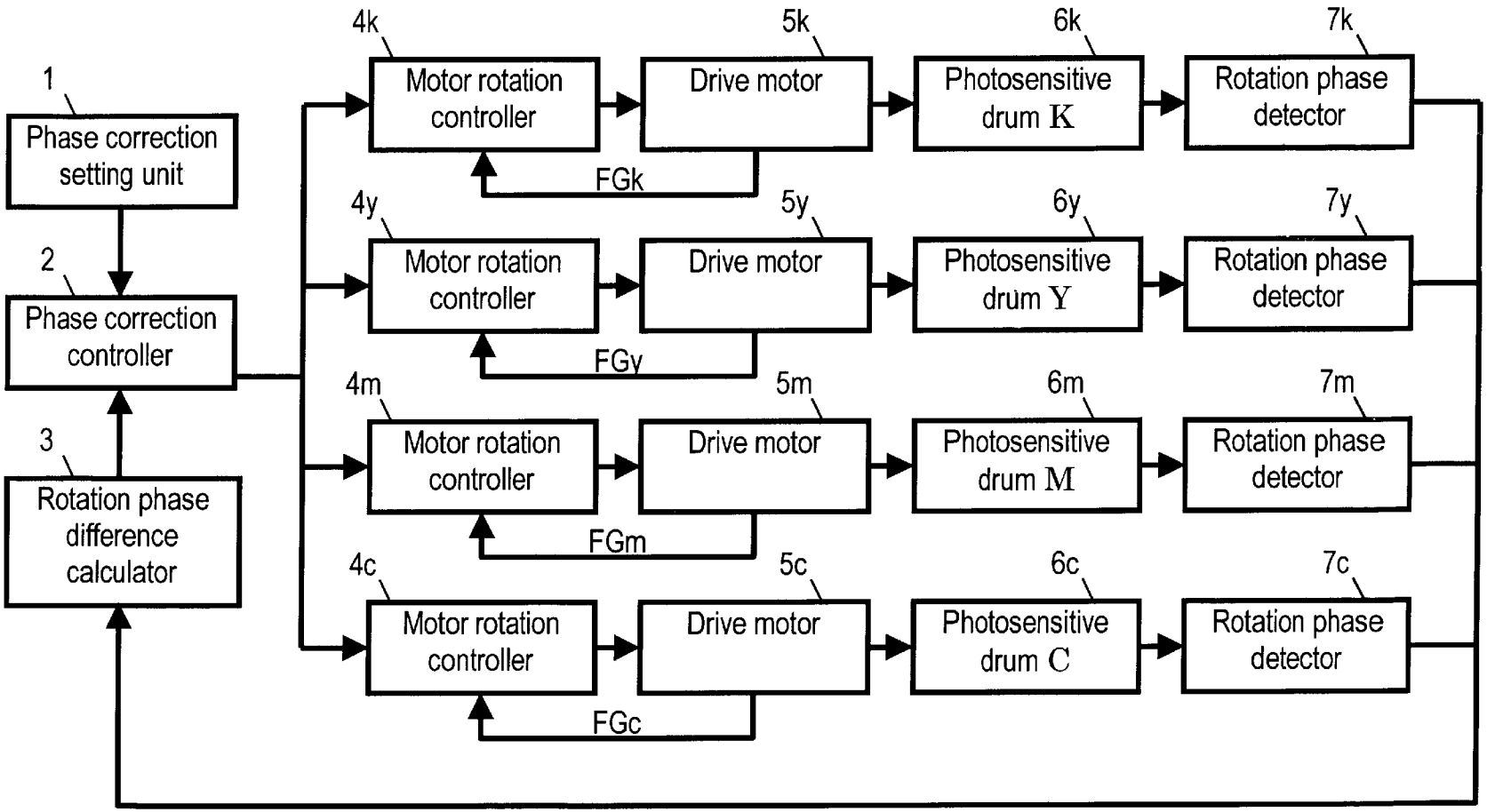
Fig.1
1
Phase correction setting unit
2
Phase correction controller
3
Rotation phase difference calculator
4k
Motor rotation controller
4y
Motor rotation controller
4m
Motor rotation controller
4c
Motor rotation controller
FGk
FGy
FGm
FGc
5k
Drive motor
5y
Drive motor
5m
Drive motor
5c
Drive motor
6k
Photosensitive drum K
6y
Photosensitive drum Y
6m
Photosensitive drum M
6c
Photosensitive drum C
7k
Rotation phase detector
7y
Rotation phase detector
7m
Rotation phase detector
7c
Rotation phase detector

COLOR IMAGE FORMING APPARATUS WITH PHASE CORRECTION CONTROLLER

FIELD OF THE INVENTION

The present invention relates to a color image forming apparatus for controlling registration in sub-scanning direction of an image formed on each photosensitive drum by scanning a plurality of photosensitive drums individually by a plurality of laser scanning units.

BACKGROUND OF THE INVENTION

In a conventional image forming apparatus of electrophotographic type, a uniform electric charge of about 1 millicoulomb per square centimeter is applied on the surface of a photosensitive drum. This photosensitive drum is exposed depending on the image information, and the electric charge of the irradiated portion is released to the photosensitive drum substrate, and an image (electrostatic latent image) is formed as a result of distribution of electric charge. This electrostatic latent image is developed by coloring charged particles (toner particles), and a powder image is formed (toner development). The powder image is transferred onto a sheet material or the like. The transferred powder image is fused and fixed by heat or other energy, and formed as an image.

Recently, on the other hand, the image by the image forming apparatus of electrophotographic type is becoming colorful. As the color image forming apparatus, a color image forming apparatus of tandem engine type is proposed. This color image forming apparatus includes a plurality of image forming stations having photosensitive drums. The plurality of image forming stations are image forming stations for forming cyan image, magenta image, yellow image, and, preferably, black image on each photosensitive drum. The powder image formed on each photosensitive drum is overlaid on an intermediate transfer material at transfer position of each color powder image, and transferred and synthesized. In the color image forming apparatus of tandem engine type, the image can be formed at high speed because each image is formed parallel in each color.

In the case of such color image forming apparatus, each powder image formed in a different image forming station may be deviated in position due to positioning error between image forming stations, resulting in color deviation. To develop a color image forming apparatus of high quality, such color deviation is a serious problem, and the technique for correcting color deviation (registration) is required.

In the first place, a reference pattern for detecting color deviation (hereinafter called registration pattern) is drawn. The registration pattern is detected by a plurality of sensors (color deviation detection), and the deviation amount is detected from this result. On the basis of the calculated deviation amount, each image is positioned (color deviation correction).

The operation and color deviation detection of the conventional color image forming apparatus are described below.

FIG. 10 is a structural diagram showing a general color image forming apparatus, FIG. 11 is a structural diagram showing a color deviation detector, FIG. 12 is a layout diagram showing configuration of registration pattern and color deviation detector on an intermediate transfer material, and FIG. 13 is a block diagram showing a conventional drive unit.

First, the configuration in FIG. 10 is explained. The image forming apparatus has four image stations 21*k*, 21*y*, 21*m*, 21*c*. The image stations 21*k*, 21*y*, 21*m*, 21*c* have photosensitive drums 22*k*, 22*y*, 22*m*, 22*c*, respectively.

Around the circumference of the photosensitive drums 22*k*, 22*y*, 22*m*, 22*c*, the following components are disposed:

a) chargers 23*k*, 23*y*, 23*m*, 23*c*, b) exposure units 26*k*, 26*y*, 26*m*, 26*c* of scanning optical system for irradiating the photosensitive drums 22*k*, 22*y*, 22*m*, 22*c* with laser beams 29*k*, 29*y*, 29*m*, 29*c* depending on the image information, c) developing units 24*k*, 24*y*, 24*m*, 24*c*, d) transfer units 28*k*, 28*y*, 28*m*, 28*c* in a transfer section 27, and e) cleaning units 25*k*, 25*y*, 25*m*, 25*c*.

Herein, the image stations 21*k*, 21*y*, 21*m*, and 21*c* are the units for forming black image, yellow image, magenta image, and cyan image, respectively. On the other hand, so as to pass through the image stations 21*k*, 21*y*, 21*m*, and 21*c*, an intermediate transfer belt 32 is disposed beneath the photosensitive drums 22*k*, 22*y*, 22*m*, 22*c*, and moves in the direction of arrow A.

In the conventional color image forming apparatus having such constitution, the image forming operation is as follows.

First, at the image forming station 21*k*, the surface of the photosensitive drum 22*k* is uniformly charged with an electrostatic charge by the charger 23*k*.

Then, an electrostatic latent image corresponding to image information of black component is formed on the photosensitive drum 22*k* by means of the exposure unit 26*k*.

This electrostatic latent image is developed on the photosensitive drum 22*k* as a powder image by black toner particles by the developing unit 24*k*.

This powder image is transferred on the intermediate transfer belt 32 as a black toner image by the transfer unit 28*k*.

The surface of the photosensitive drum 22*k* after transfer process is cleaned by the cleaning unit 25*k*, and residual toner particles are removed to be ready for next image formation.

On the other hand, parallel to the timing of formation of the black toner image, at the image forming station 21*y*, the surface of the photosensitive drum 22*y* is uniformly charged with an electrostatic charge by the charger 23*y*, and an electrostatic latent image corresponding to the image information of yellow component is formed on the photosensitive drum 22*y* by the exposure unit 26*y*.

This electrostatic latent image is developed on the photosensitive drum 22*y* as a powder image by yellow toner particles by the developing unit 24*y*, and it is laid over the black toner image formed on the intermediate transfer belt 32, and formed as a synthetic toner image.

Similarly, thereafter, a magenta toner image is overlaid by the image forming station 21*m*, and a cyan toner image by the image forming station 21*c* sequentially on the intermediate transfer belt 32. In this way, the synthetic toner image is formed by overlaying four color toner images on the intermediate transfer belt 32.

After the transfer process, the photosensitive drums 22*k*, 22*y*, 22*m*, 22*c* are cleaned by the cleaning units 25*k*, 25*y*, 25*m*, 25*c*, and residual toner particles are removed to be ready for next image formation, and the printing operation is finished.

After completion of formation of the synthetic toner image, a sheet material 35 of paper or the like is supplied in between the intermediate transfer belt 32 and a transfer roller 37 from a paper feed cassette 34 through a paper feed roller 36. The transfer roller 37 is disposed at a position contacting with the intermediate transfer belt 32 for inserting the sheet material 35 between it and the intermediate transfer belt 32. When the sheet material 35 is supplied, the synthetic toner image is transferred on the sheet material 35. Then, after being heated and fixed by a fixing unit 38, a color image is formed on the sheet material 35.

As shown in FIG. 13, the drive unit is controlled depending on a control signal from a control unit 50 such as CPU for controlling the operation of the entire apparatus, and a motor rotation controller 51 starts a drive motor 52, and controls its rotating speed. A drive transmission unit 53 transmits the drive force to a rotation moving unit 54 by gear or the like from a rotary shaft of the drive motor 52. By this driving force, the rotation moving unit 54 including the photosensitive drums 22*k*, 22*y*, 22*m*, 22*c*, intermediate transfer belt 32, heating roller 38*a* in the fixing unit 38, and others is rotated and driven.

As the drive motor 52, when a known stepping motor (not shown) is used, the motor rotation controller 51 controls the rotating speed by issuing a control signal of frequency corresponding to the rotating speed.

On the other hand, when a DC motor (not shown) is used as the drive motor 52, the motor rotation controller 51 controls the rotating speed of the drive motor by, for example, phase locked loop "PLL" control system. That is, the rotation controller 51 detects an FG signal (a) for generating a frequency proportional to the rotating speed of the drive motor 52, and controls so that the phase and frequency of the FG signal (a) may coincide with the reference clock frequency (not shown), thereby controlling at constant speed rotation.

In such image forming apparatus of tandem engine type, however, color deviation may occur in the following cases:

1) Unstable temperature when turning on the power.
2) Exchange of image forming stations 21*k*, 21*y*, 21*m*, 21*c*.
3) Setting condition of the image forming apparatus.
4) Deviation of the image forming stations 21*k*, 21*y*, 21*m*, 21*c* due to temperature changes in the apparatus.
5) Deviation of mounting of scanning optical system.

In the event of color deviation as mentioned above, correction of color deviation in the conventional image forming apparatus is described below.

As shown in FIG. 10, a sensor unit 39 for detecting color deviation is disposed at the downstream side of the image forming stations 21*k*, 21*y*, 21*m*, 21*c*. As shown in FIG. 11, the sensor unit 39 is composed of a CCD 40, a light source 41 such as lamp, and a SELFOC lens array 42 for focusing the reflected light on the CCD 40.

As shown in FIG. 12, the sensor unit 39 is disposed on the line of the pixels 40*a*, 40*b* in the CCD 40 crossing orthogonally with the conveying direction A of the intermediate transfer belt 32. The sensor unit 39 is disposed at two positions, near the image forming start position and image forming end position on the intermediate transfer belt 32.

In such constitution, the detecting operation of color deviation is described below.

Same as in the printing operation, a registration pattern of preliminarily specified line or pattern is formed. For example, as shown in FIG. 12, color toner images 43, 44, 45, 46 are transferred at prescribed intervals between a dotted line 47 including the scanning start position of the exposure unit and a dotted line 48 including the scanning end position on the line crossing orthogonally with the running direction A of the intermediate transfer belt 32. Sensor units 39*a* and 39*b* measure the amount of position deviation of each color (color deviation). For example, the position deviation in the main scanning direction (vertical direction to direction A in FIG. 12) is detected as the error from the predetermined design value by detecting the writing start position of main scanning direction of each color when the color registration patterns 43, 44, 45, 46 on the intermediate transfer belt 32 pass through the CCD 40*a* in the sensor unit 39*a*. The position deviation in the sub-scanning direction (direction A in FIG. 12) is detected by operating the position deviation of each color ($\Delta Y1=\Delta T1 \cdot v$) from the time difference ($\Delta T=T-T1$, where T is the predetermined design value) of time T1 of color registration patterns 43, 44, 45, 46 on the intermediate transfer belt 32 passing through the CCD 40*a* in the sensor unit 39*a* and the predetermined design value, and the conveying speed v. In other skew error (inclination in main scanning direction) and multiplication error in main scanning direction (error of print region width in main scanning direction), they can be detected by forming registration patterns in specified shape corresponding to each, and detecting and operating.

In various color deviations thus detected, the correction operation is described below.

For position deviation in the main scanning direction, the control unit 33 for determining the writing start position in the main scanning direction controls the image data writing start timing of the exposure units 26*k*, 26*y*, 26*m*, 26*c* independently for each color. In this manner, the writing start position in the main scanning direction is corrected.

For position deviation in the sub-scanning direction, the writing timing signal in the sub-scanning direction showing the print region in the sub-scanning direction is controlled independently for each color. Thus, the printing region in the sub-scanning direction is controlled, and the position deviation in the sub-scanning direction is corrected.

Further, skew error and main scanning direction error are corrected by using the image processing technique.

However, the position deviation in the sub-scanning direction is corrected by detecting the position deviation regarded to be always a specific position deviation in the pattern of each color at any position when the registration pattern is formed repeatedly (hereinafter called "position deviation of DC component"). However, the position deviation of the registration pattern due to period fluctuations (hereinafter called "position deviation of AC component") occurring due to the factor explained below cannot be corrected. This position deviation of AC component occurs due to speed fluctuations of the surface of photosensitive drum of each color, speed fluctuations of the surface of intermediate transfer belt, etc.

Speed fluctuations of the surface of photosensitive drum of each color are caused by:

Variation of rotation of drive motor for driving,

Uneven pitch occurring in the transmission gear train for transmitting the driving force of the drive motor, Speed fluctuations due to eccentric rotation of the gear or speed fluctuations due to eccentric rotation of the photosensitive drum itself, and others.

In this case, the position deviation of AC component occurs as fluctuation in the period of the peripheral length of photosensitive drum. The AC component of each color varies in the fluctuation phase.

Speed fluctuations of the surface of intermediate transfer belt are caused by:

Variation of rotation of drive motor for driving,

Uneven pitch occurring in the transmission gear train for transmitting the driving force of the drive motor, Speed fluctuations due to eccentric rotation of the gear or eccentric rotation of the drive roller, and others.

In this case, the position deviation of AC component occurs as fluctuation in the period of the peripheral length of intermediate transfer belt.

In the conventional color image forming apparatus, position deviation of DC component was corrected. However, in the event of position deviation of AC component in the sub-scanning direction by speed fluctuation of the photosensitive drum or intermediate transfer belt as mentioned above, it was a problem of the conventional color image forming apparatus that the print quality deteriorates.

SUMMARY OF THE INVENTION

It is hence an object of the invention to present a color image forming apparatus capable of decreasing position deviation of AC component in sub-scanning direction and preventing deterioration of print quality.

To achieve the object, the color image forming apparatus of the invention comprises:

a) a plurality of image stations including photosensitive drums and developing unit for developing the latent images formed on the photosensitive drums as sensible toner images, b) a transfer unit for transferring and conveying the toner images formed in the plurality of image stations onto an intermediate transfer material, c) a plurality of exposure units for irradiating the individual photosensitive drums in the plurality of image stations with light for forming latent images, d) a plurality of drive motors for driving the plurality of photosensitive drums independently, e) a plurality of motor rotation controllers for controlling rotation and driving of the plurality of drive motors independently, f) a plurality of rotation phase detectors for detecting the rotation phase of each one of the plurality of photosensitive drums rotated and driven by the drive motors, g) a rotation phase difference calculator for calculating the rotation phase difference of the other photosensitive drums corresponding to the rotation phase of the specified photosensitive drum as the reference among the rotation phases detected by the plurality of rotation phase detectors, h) a phase correction setting unit for setting the rotation phase difference in printing operation, and i) a phase correction controller for correcting rotation phase of the photosensitive drum on the basis of the calculated rotation phase difference and the set rotation phase difference.

The color image forming apparatus having such constitution forms a synthesized image by overlaying the toner images developed at the plurality of image stations sequentially on the intermediate transfer material.

In this constitution, a color image forming apparatus capable of decreasing the position deviation of AC component in the sub-scanning direction and preventing deterioration of print quality can be obtained.

BRIEF DESCRIPTION OF THE DRAWINGS

FIG. 1 is a block diagram showing a drive unit of a color image forming apparatus in embodiment 1 of the invention.

DETAILED DESCRIPTION OF THE PREFERRED EMBODIMENTS

Embodiments of the invention are described below while referring to FIG. 1 to FIG. 11.

Embodiment 1

FIG. 1 is a block diagram showing a drive unit of a color image forming apparatus in embodiment 1 of the invention.

In FIG. 1, DC motors are used as photosensitive drum drive motors 5*k*, 5*y*, 5*m*, 5*c*, and Hall elements (not shown) for detecting the rotating speed are provided inside. Frequency signals from Hall elements, FGk, FGy, FGm, FGc, are supplied into motor rotation controllers 4*k*, 4*y*, 4*m*, 4*c*. Herein, the motor rotation controllers 4*k*, 4*y*, 4*m*, 4*c* are PLL (phase locked loop) control circuits (not shown). Accordingly, the motor controllers control the rotating speed of the drive motors 5*k*, 5*y*, 5*m*, 5*c* so that the phase and frequency may coincide with the input reference clock (not shown) and the frequency signal. The drive motors 5*k*, 5*y*, 5*m*, 5*c* rotate at a specific speed corresponding to the reference clock frequency.

Figure 2:
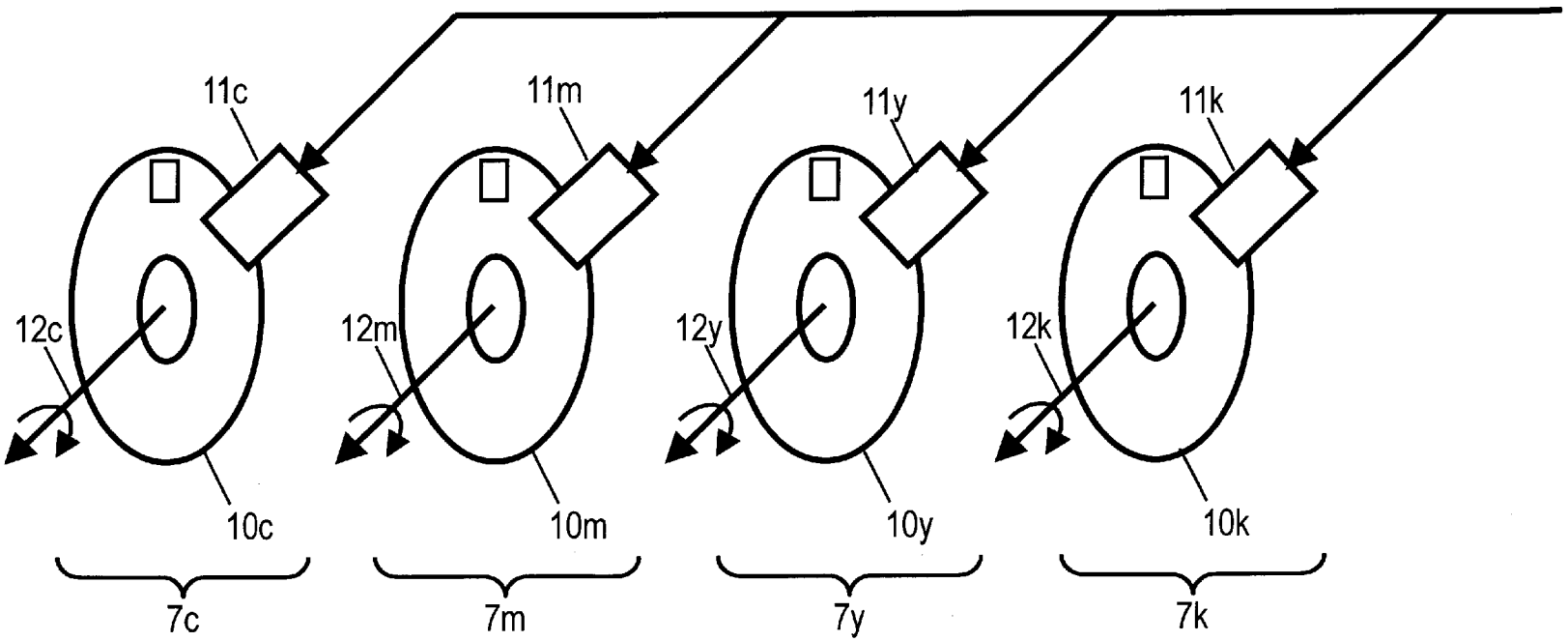
FIG. 2 is a structural diagram showing a rotation phase detector.
Figure 9A:
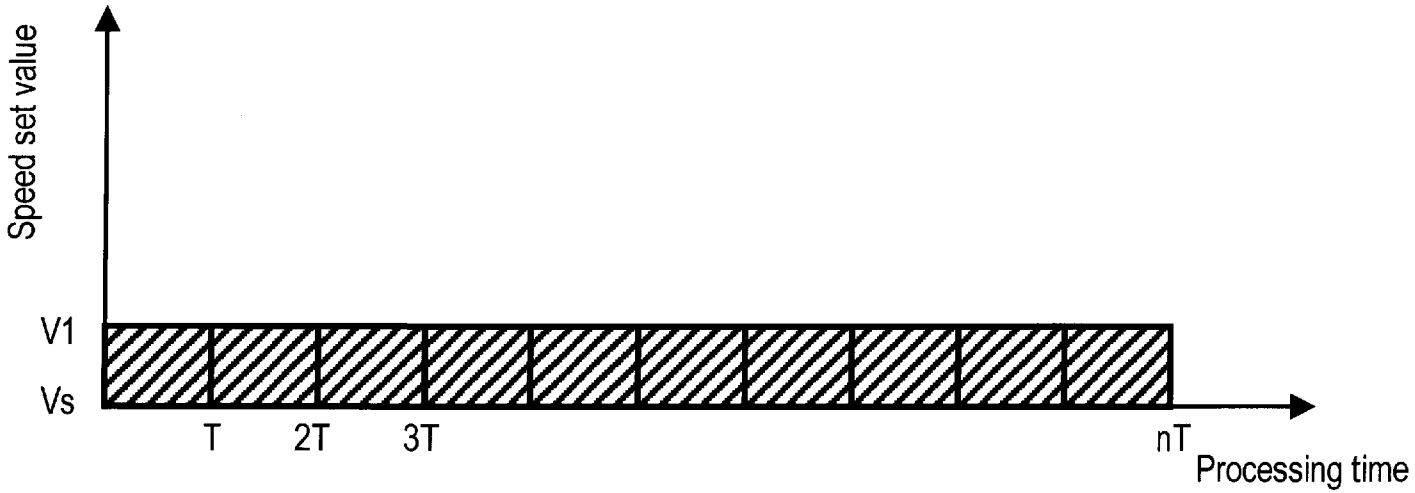
FIG. 9A is an explanatory diagram showing speed setting changeover of photosensitive drum drive motor for phase control.
Figure 9B:
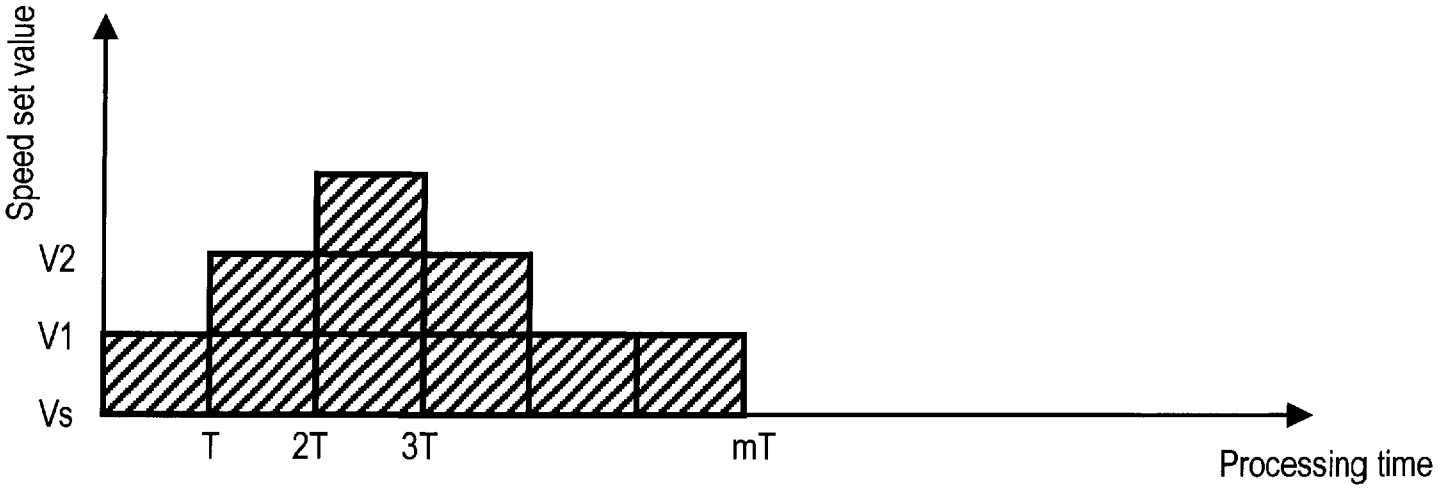
FIG. 9B is an explanatory diagram showing speed setting changeover of photosensitive drum drive motor for phase control.
Figure 10:
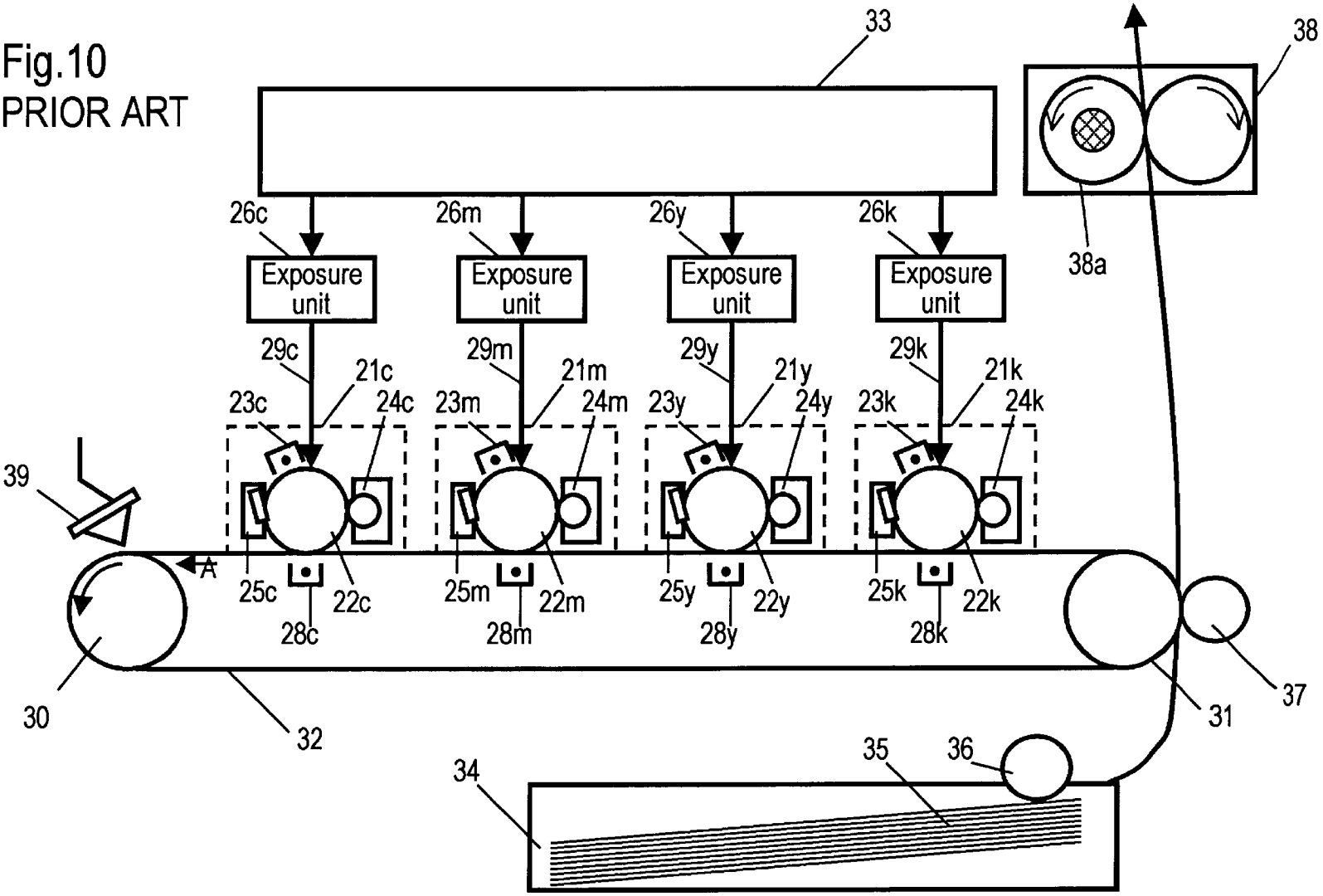
Fig.10 PRIOR ART
FIG. 10 is a structural diagram showing a general color image forming apparatus.
Figure 11:
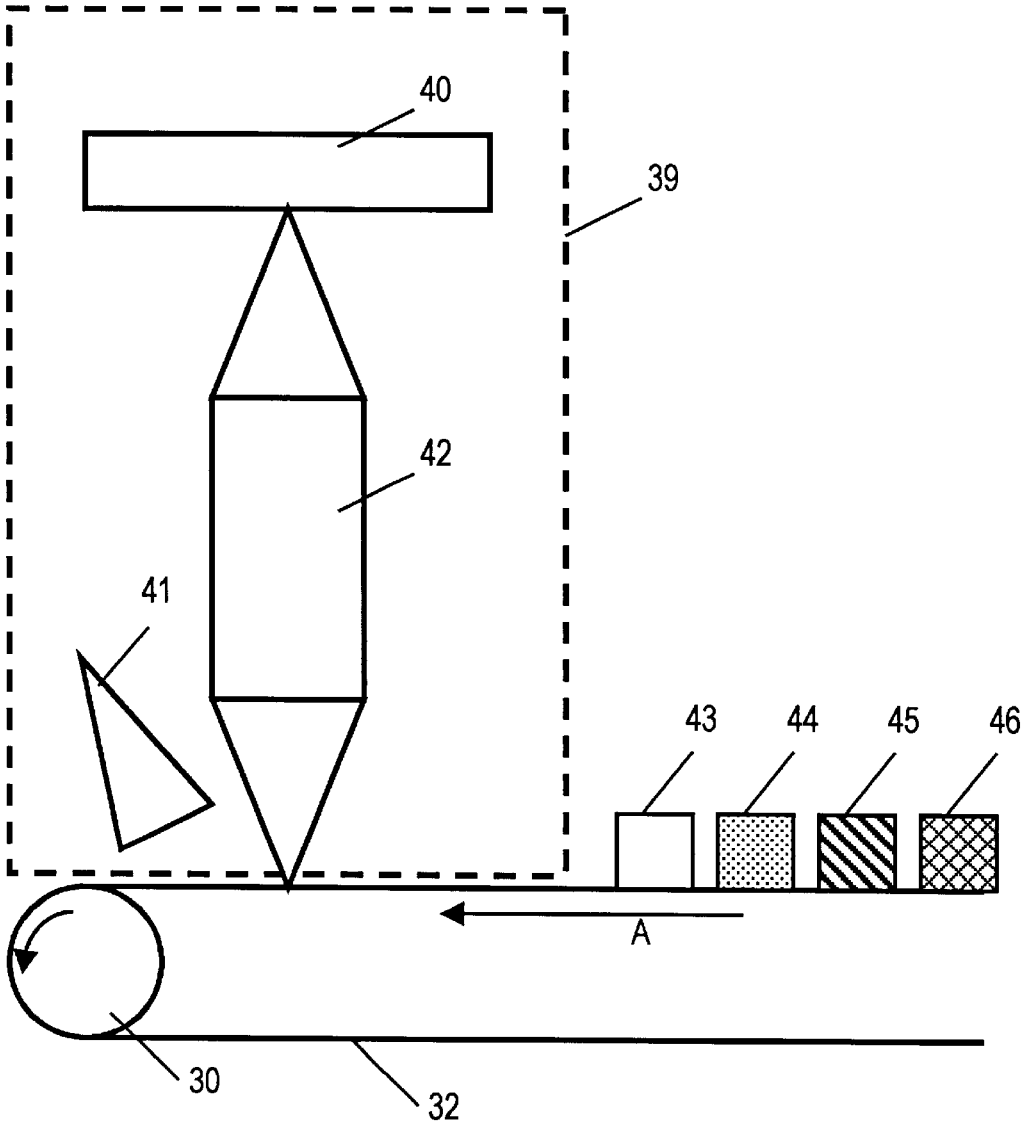
Fig.11 PRIOR ART
FIG. 11 is a structural diagram showing a color deviation detector.

The photosensitive drums 6*k*, 6*y*, 6*m*, 6*c* are rotated and driven by the drive motors 5*k*, 5*y*, 5*m*, 5*c*, and they are same as the photosensitive drums 22*k*, 22*y*, 22*m*, 22*c* provided in the image forming stations 21*k*, 21*y*, 21*m*, 21*c* of black K, cyan C, magenta M, and yellow Y shown in FIG. 9. Rotation phase detectors 7*k*, 7*y*, 7*m*, 7*c* have encoder plates 10*k*, 10*y*, 10*m*,10*c* for home position detection and transmission sensors 11*k*, 11*y*, 11*m*, 11*c* as shown in FIG. 2. The rotation phase detectors issue home signals in one revolution period of photosensitive drums, and detect the rotation phase of the photosensitive drums 6*k*, 6*y*, 6*m*, 6*c*. The photosensitive drums 6*k*, 6*y*, 6*m*, 6*c* rotate about rotary shafts 12*k*, 12*y*, 12*m*, 12*c*, respectively.

Herein, the black image forming station is mentioned as K for simplifying the description. Similarly, the cyan image forming station is mentioned as C for simplifying the description. Similarly, the magenta image forming station is mentioned as M for simplifying the description. Similarly, the yellow image forming station is mentioned as Y for simplifying the description.

Accordingly, the output signal of the rotation phase detector 7*k* is mentioned as home signal of K. Similarly, the output signal of the rotation phase detector 7*y* is mentioned as home signal of Y. Similarly, the output signal of the rotation phase detector 7*m* is mentioned as home signal of M. Similarly, the output signal of the rotation phase detector 7*c* is mentioned as home signal of C.

Figure 3:
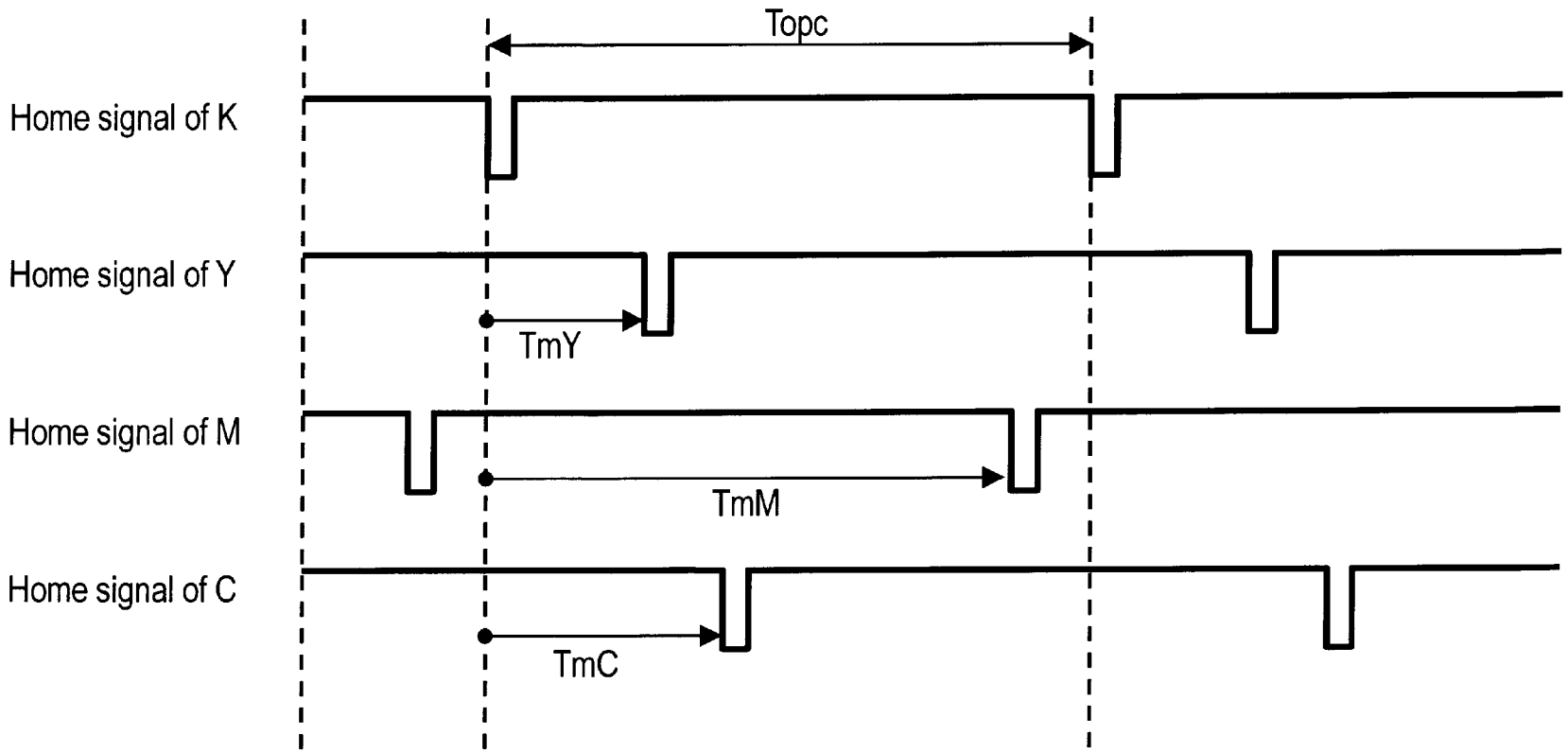
FIG. 3 is a diagram showing output signal timing of home signal of K, home signal of Y, home signal of M, and home signal of C.

FIG. 3 shows the output signal timing of home signal of K, home signal of Y, home signal of M, and home signal of C.

The rotation phase difference calculator 3 shown in FIG. 1 calculates the phase deviation time of the home signal of other colors (Y, M, C) from the home signal of K, out of the home signal of K, home signal of Y, home signal of M, and home signal of C. The phase correction setting unit 1 sets whether or not to execute phase correction, and sets the rotation phase difference of photosensitive drums 6*y*, 6*m*, 6*c* in the print operation when executing the phase correction. The phase correction setting unit 1 is equivalent to the color deviation detector 39 explained in the prior art, and its description is omitted. The phase correction setting unit 1 may have an input setting unit capable of making various settings by key input signal by user or external input signal.

The phase correction controller 2 calculates the phase correction amount of home signals of other colors (Y, M, C) with respect to the home signal of K of the photosensitive drum 6*k* on the basis of the following two types of phase difference. That is, the two types of phase difference are:

1. Rotation phase difference of other photosensitive drums 6*y*, 6*m*, 6*c* with respect to the rotation phase of the photosensitive drum 6*k* in print operation obtained from the phase correction setting unit 1, and
2. Phase difference of home signals of other colors (Y, M, C) with respect to the home signal of K of the photosensitive drum 6*k* obtained from the rotation phase difference calculator 3.

The phase correction controller 2 changes over the reference clock frequency of PLL control from the calculated phase correction amount, and controls the phase correction of home signals of other colors (Y, M, C). Also the phase correction controller 2 stores the rotation phase difference of other photosensitive drums 6*y*, 6*m*, 6*c* with respect to the rotation phase of the photosensitive drum 6*k* in print operation obtained from the phase correction setting unit 1 in a nonvolatile memory (not shown).

As the nonvolatile memory, preferably, EEPROM (electrically erasable and programmable ROM) or flash memory may be used, but any memory may be used as far as the data is not lost when the power source is turned off, or SRAM or other memory may be used if provided with a mechanism not losing the data when the power source is turned off, such as backup battery.

Figure 8:
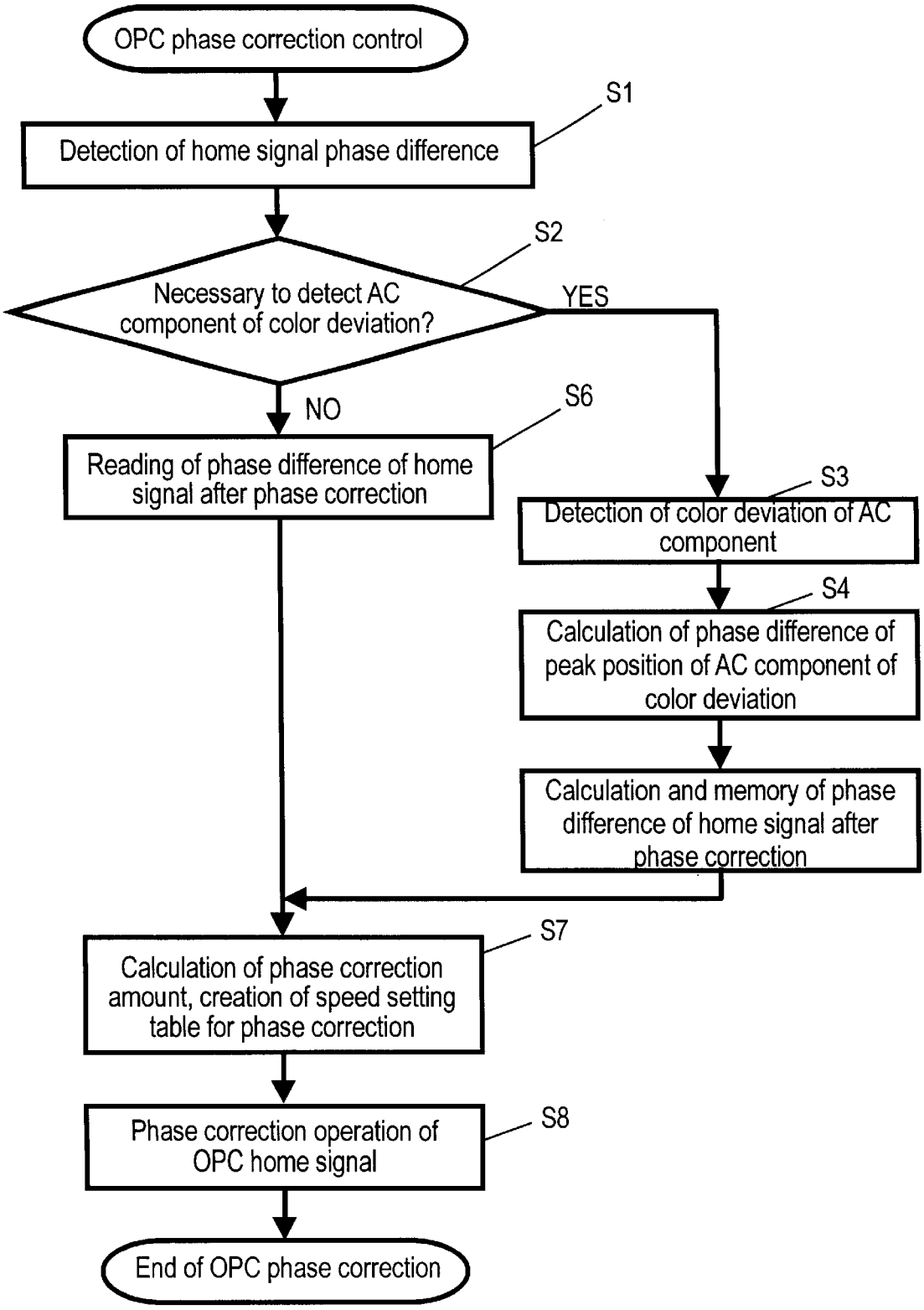
FIG. 8 is a flowchart showing the operation of the phase correction control of photosensitive drums in the drive unit in FIG. 1.

The operation of the phase correction control of photosensitive drum in the drive unit in FIG. 1 is described specifically below while referring to the flowchart in FIG. 8.

S1 (Detection of Home Signal Phase Difference)

First, the photosensitive drums 6*k*, 6*y*, 6*m*, 6*c* are driven at rotating speed $V_0$ in ordinary printing. For this purpose, the phase correction controller 2 sets the PLL control reference clock $f_0$ in the motor rotation controllers 4*k*, 4*y*, 4*m*, 4*c*. By this setting, the drive motors 5*k*, 5*y*, 5*m*, 5*c* drive the photosensitive drums at rotating speed $V_0$. At this time, from the rotation phase detectors 7*k*, 7*y*, 7*m*, 7*c*, as shown in FIG. 3, home signal of K, home signal of Y, home signal of M, and home signal of C of period Topc each are issued. Herein, the rotation phase difference calculator 3 detects the phase difference of home signals of other colors (Y, M, C) with respect to the home signal of K, and calculates TmY, TmM, and TmC.

S2 (Judgement Whether Detection of Color Deviation AC Component Is Necessary or Not)

Consequently, the phase correction controller 2 judges whether necessary or not to detect the color deviation AC component. That is, when the color deviation AC component detection is possible, it is judged the color deviation AC component detection is required:

if before start of printing operation, if any one of image stations 21*k*, 21*y*, 21*m*, 21*c* is replaced, if after turning on the power source of the apparatus, or if paper jamming occurs as the printing paper is not conveyed normally in the apparatus during printing operation and after jamming treatment for removing the clogged printing paper.

Incidentally, the information before start of printing operation or after jamming treatment is fed into the controller 33 from the jam detector (not shown) or the like.

S3 (Color Deviation Detection of AC Component)

If judged necessary to detect color deviation AC component at step S2, the color deviation of AC component is detected. First, in order to detect the AC component of position deviation in the sub-scanning direction, the registration pattern is formed on the intermediate transfer belt 32 by the photosensitive drum 22*k*.

S4 (Calculation of Peak Position Phase Difference of AC Component)

Consequently, the peak position phase difference of color deviation AC component of each color is calculated.

S5 (Calculation of Phase Correction Set Value)

The phase correction set value is calculated in order to match the peak position of the AC component.

S6 (Reading of Home Signal Phase Difference After Phase Correction)

If judged not necessary to detect the color deviation AC component at step S2, the home signal phase difference set value after phase correction is read in from the nonvolatile memory.

S7 (Calculation of Phase Correction Amount)

The phase correction amount is calculated from the present phase difference.

S8 (Phase Correction Operation of Home Signal)

The phase correction is operated according to the calculation result at step S7.

The above operation is specifically described below.

Figure 4:
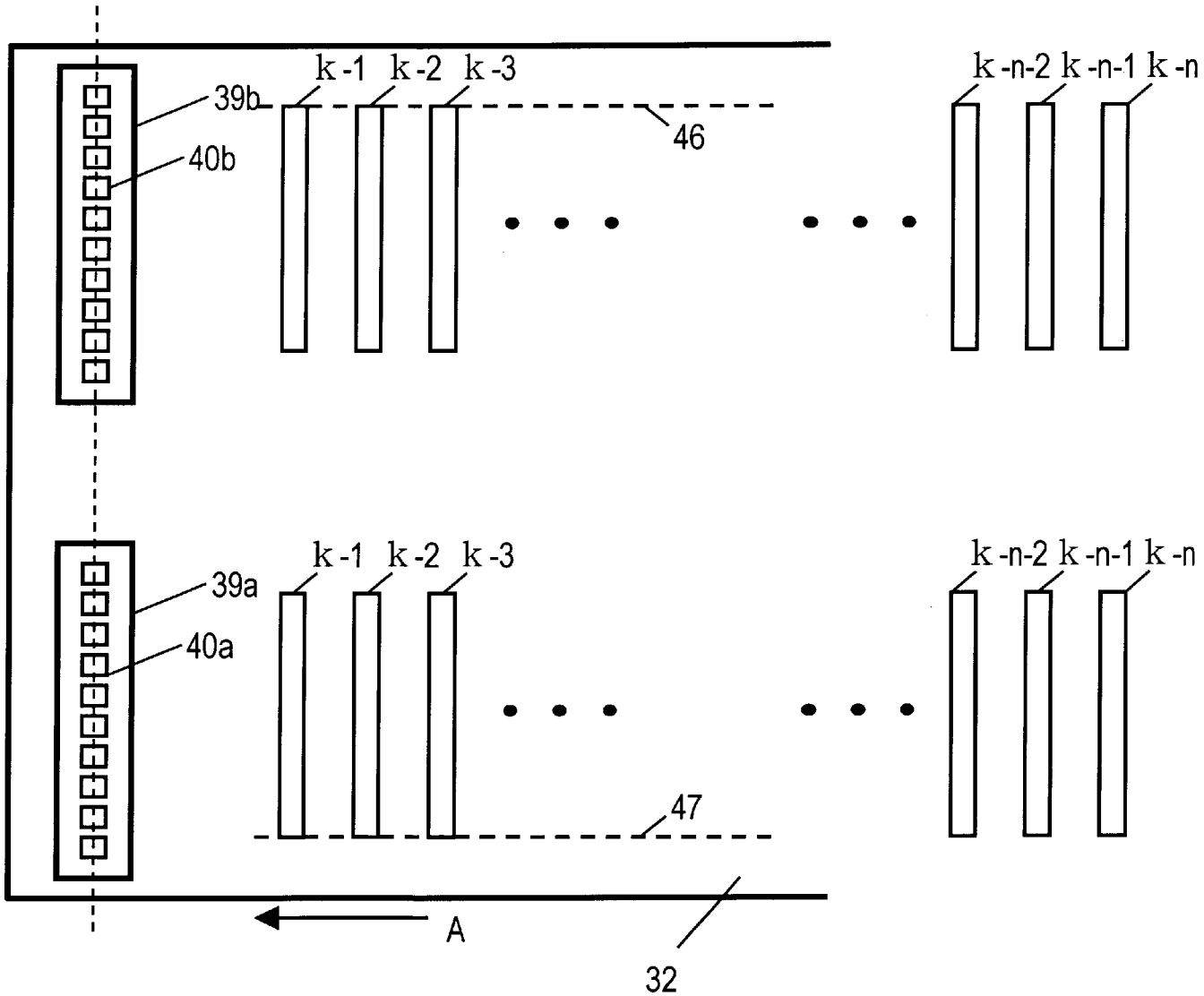
FIG. 4 is a diagram showing configuration of a plurality of registration patterns and color deviation detector on the intermediate transfer material.
Figure 12:
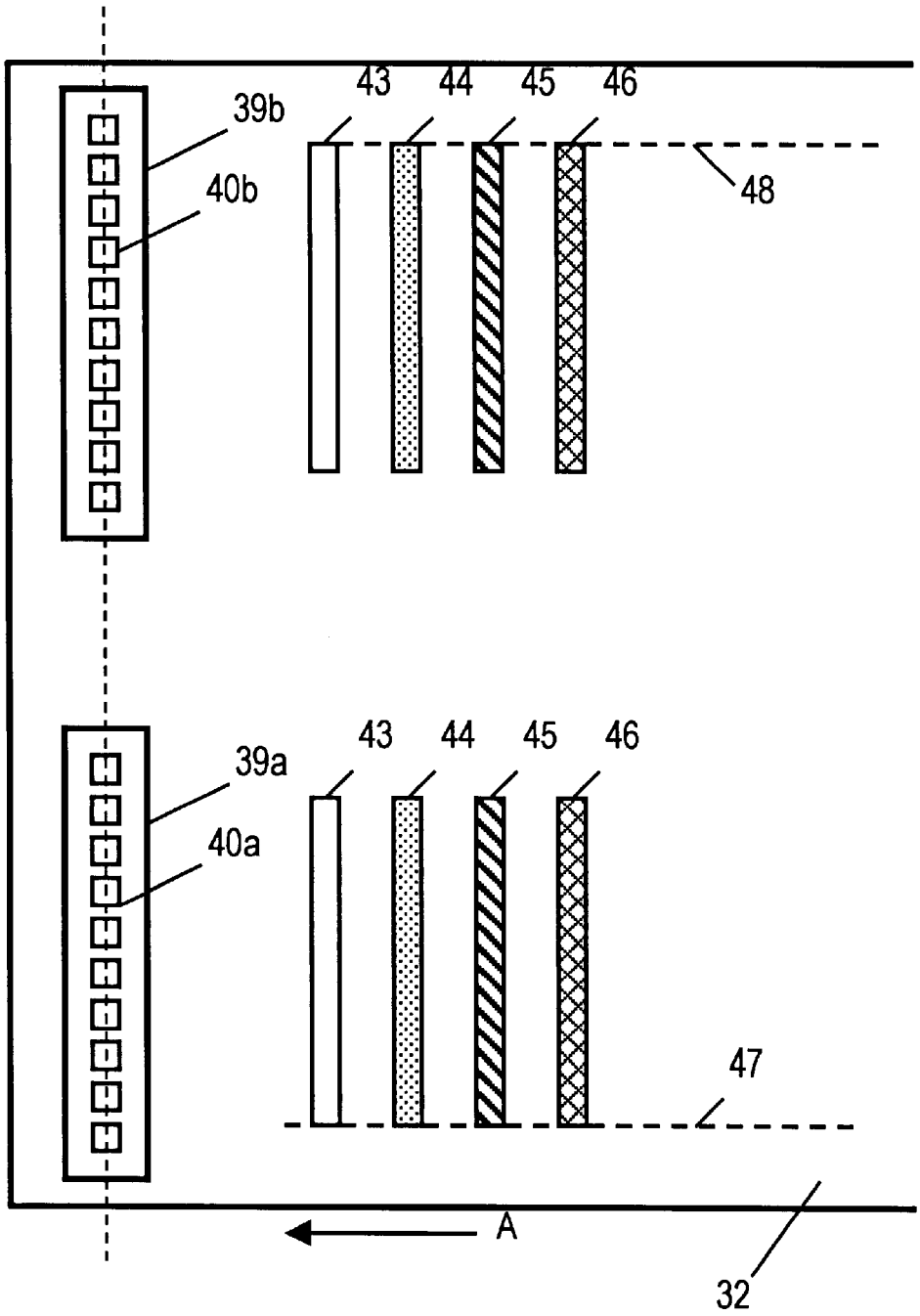
Fig.12 PRIOR ART
FIG. 12 is a layout diagram showing configuration of registration patterns and color deviation detector on the intermediate transfer material.
Figure 13:
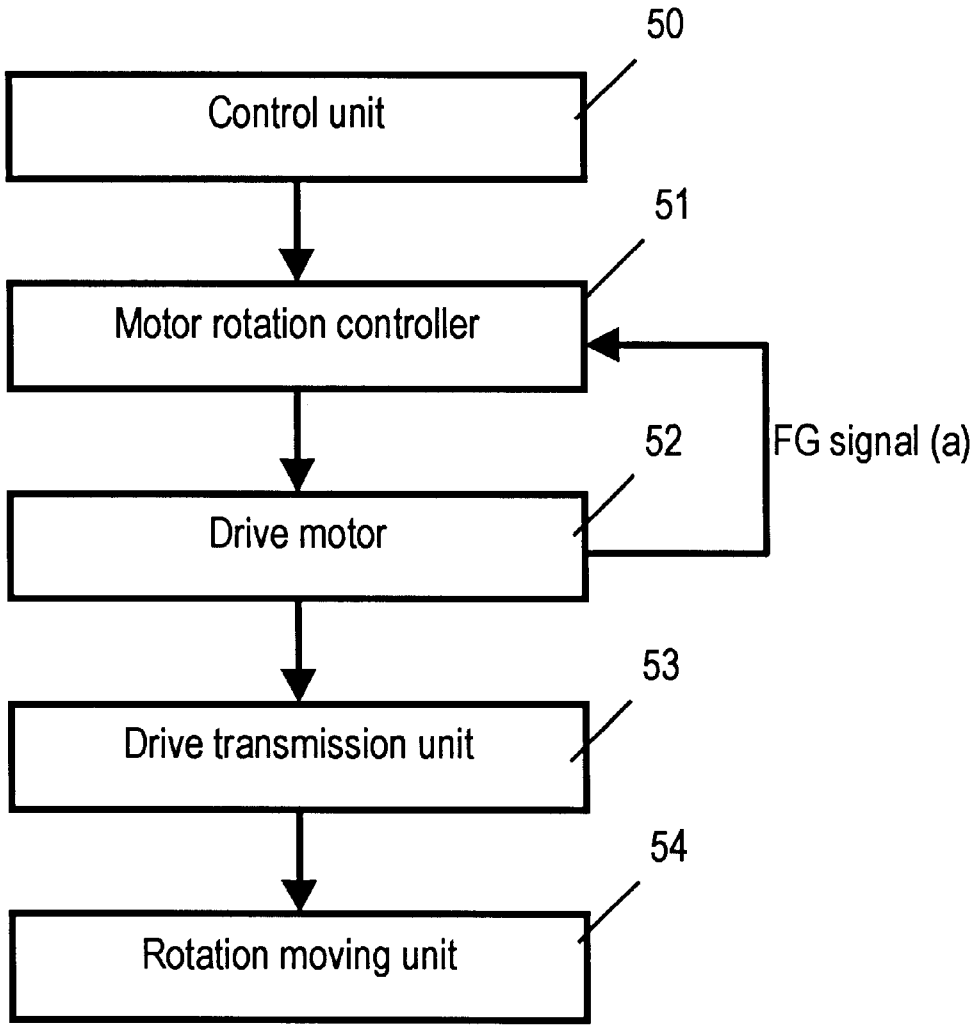
Fig.13 PRIOR ART
FIG. 13 is a block diagram showing a conventional drive unit.

First, to detect the AC component of position deviation in the sub-scanning direction, a registration pattern of K is formed on the intermediate transfer belt 32 (S3). As shown in FIG. 4, plurality of registration patterns are formed at prescribed intervals by transferring toner images sequentially. In FIG. 4, instead of the color toner images 43, 44, 45, 46 transferred at prescribed intervals shown in FIG. 12, a plurality of registration patterns of same colors are transferred on the intermediate transfer belt 32. This is for the purpose of detecting the AC component of the position deviation of K in the sub-scanning direction.

Figure 5:
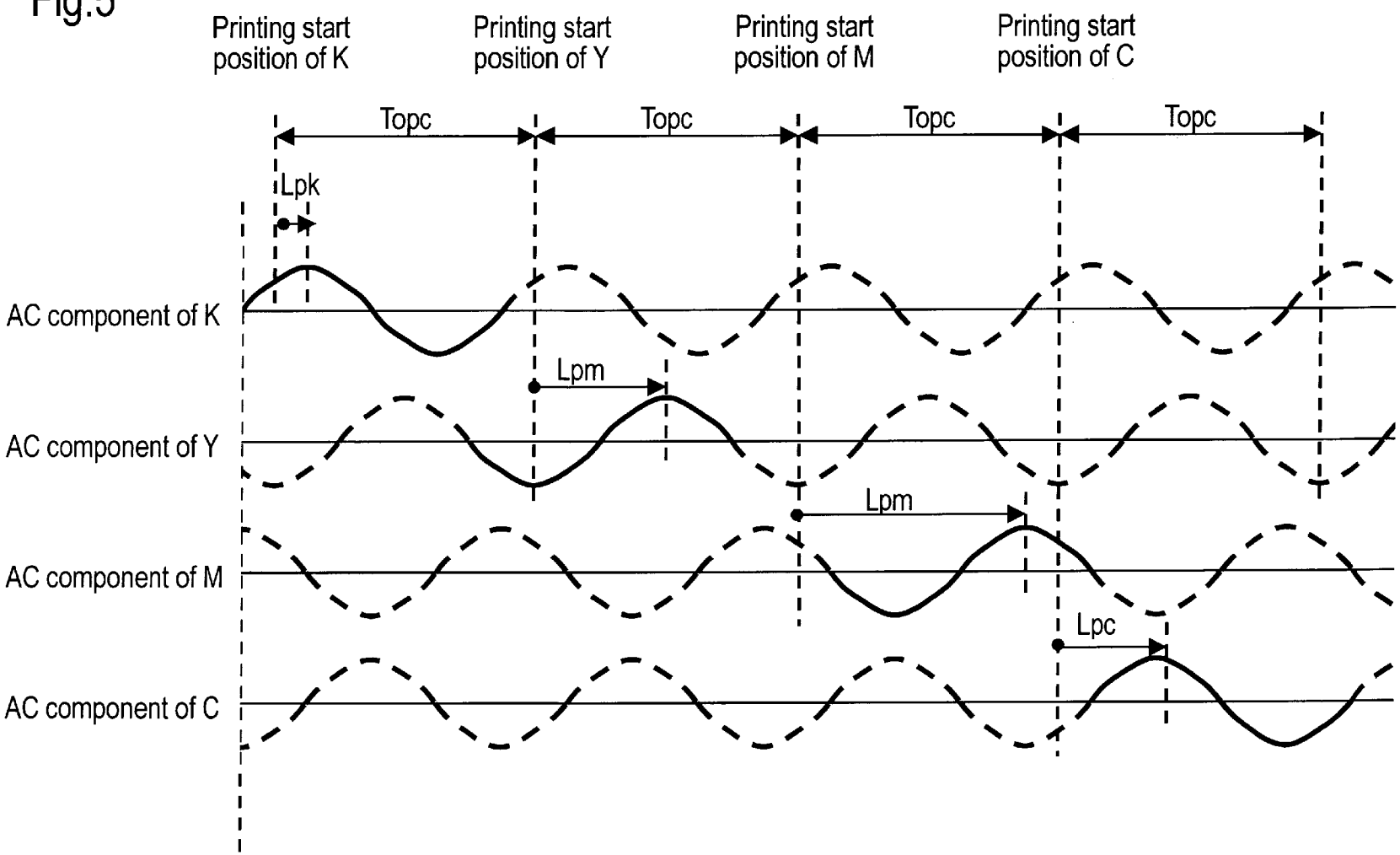
FIG. 5 is a diagram showing timing of AC component of K, AC component of Y, AC component of M, and AC component of C.

The color deviation detector 39 (phase correction setting unit 1) detects the registration pattern, and detects the AC component of position deviation in the sub-scanning direction (S3). That is, it is detected by operating the position deviation of each color ($\Delta Y1=\Delta T1\cdot v$) from the time difference ($\Delta T=T-T1$, where T is the predetermined design value) of time T1 of the registration patterns passing through the CCD 40*a* in the sensor unit 39*a* and the predetermined design value, and the conveying speed Vs. This operation is executed sequentially in each registration pattern, and the position deviation in the sub-scanning direction is detected. The detected position deviation in the sub-scanning direction includes AC components generated due to speed fluctuation on the surface of photosensitive drum 22*k*, speed fluctuation on the surface of intermediate transfer belt 32 and others. In order to extract only the AC component derived from the speed fluctuation of the photosensitive drum 22*k*, the detected data is filtered by band pass filter or the like. In this way, as shown in FIG. 5(*a*), the speed fluctuation component of the photosensitive drum 22*k* can be detected as the AC component (hereinafter called AC component of K). This AC component of K shows speed fluctuations by eccentricity of photosensitive drum 22*k* or the like, and varies in one revolution period Topc. Therefore, there is a peak position of AC component of K in a distance Lopc corresponding to one revolution period Topc from the printing start position of the photosensitive drum 22*k*, and its distance Lpk can be detected.

As for Y, M, and C, printing is started from the position of an integer multiple of distance Lopc corresponding to one revolution period Topc from the printing start position of K. Accordingly, there is a peak position of AC component of color deviation within the distance Lopc corresponding to one revolution period Topc from each printing start position. Therefore, the distances Lpy, Lpm, and Lpc can be detected. This is because the home signal of the photosensitive drum is generated as a pulse signal once in one revolution period Topc of the photosensitive drum, and the AC component of position deviation in the sub-scanning direction also fluctuates in one revolution period Topc.

Figure 6:
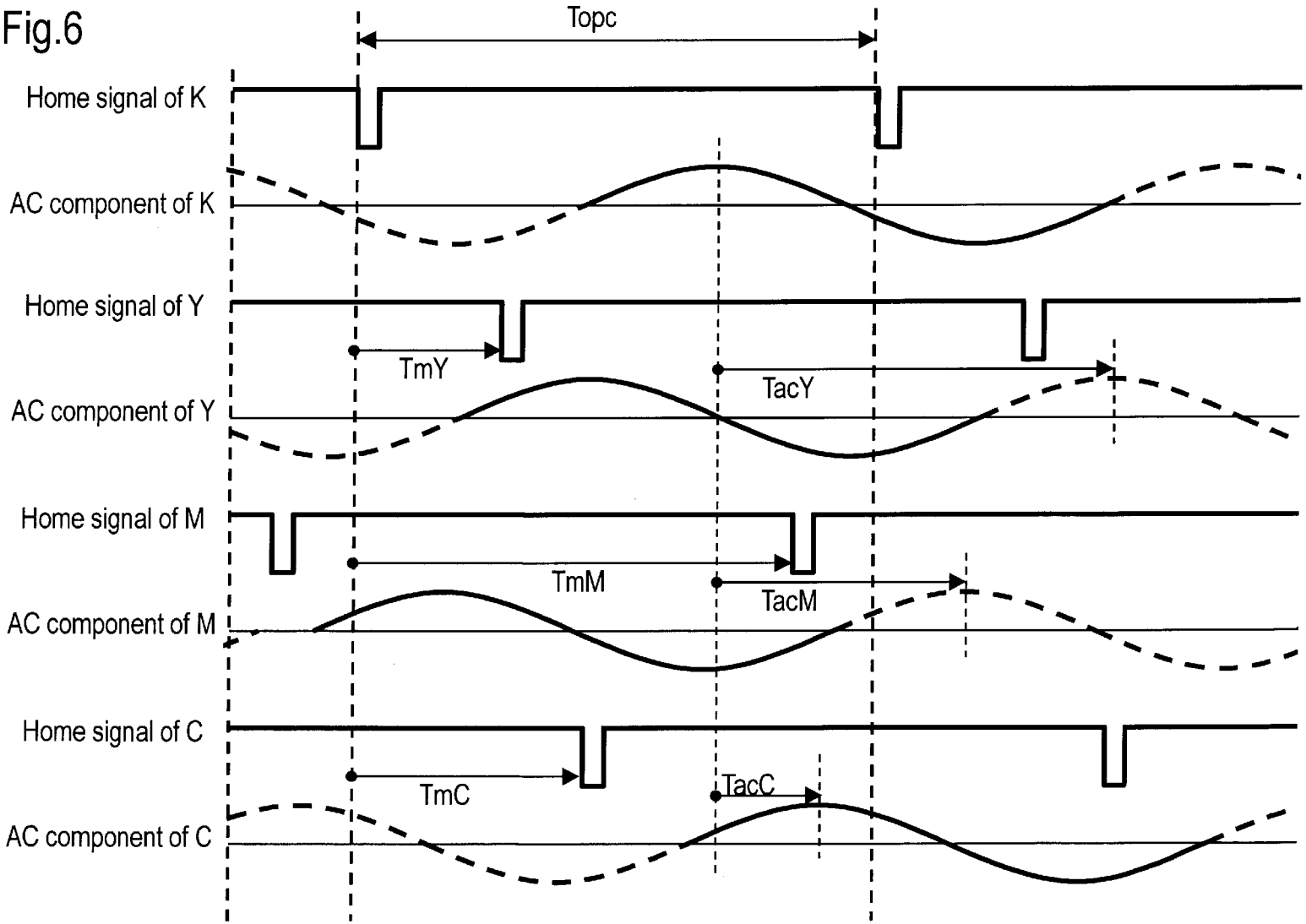
FIG. 6 is a timing diagram showing the relation of home signal of each photosensitive drum before phase correction control, and phase signal of AC component of position deviation in sub-scanning direction of each color.
Figure 7:
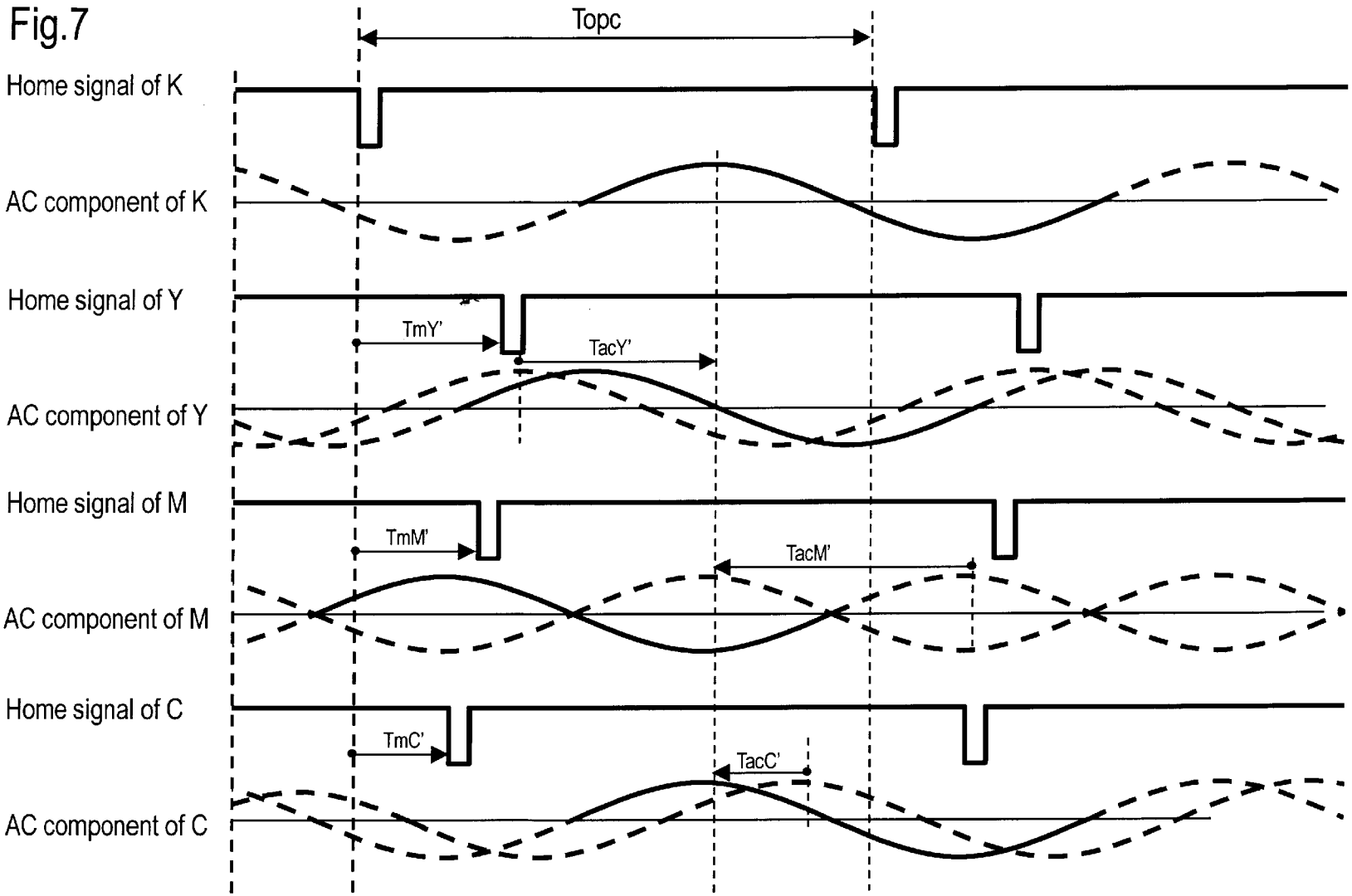
FIG. 7 is a timing diagram showing the relation of home signal of each photosensitive drum after phase correction control, and phase signal of AC component of position deviation in sub-scanning direction of each color.

Herein, supposing the phase delay time of AC component peak position of K and AC component peak position of other colors Y, M, C to be TacY, TacM, and TacC, respectively, TacY, TacM, and TacC are expressed in the following formulas (1), (2), and (3) (see FIG. 6).

$$TacY=(Lpy-Lpk)/Vs \quad (1)$$

$$TacM=(Lpm-Lpk)/Vs \quad (2)$$

$$TacC=(Lpc-Lpk)/Vs \quad (3)$$

Therefore, supposing the phase correction set values for adjusting the AC component peak positions of Y, M, C to the AC component peak position of K to be TmY', TmM', and TmC', respectively, first of all, TmY' is expressed in formula (4).

$$TmY'=TmY-TacY \quad (4)$$

But if TmY'<0, it is expressed in formula (5).

$$TmY'=TmY'+Topc=TmY-TacY+Topc \quad (5)$$

Or in the case of TmY'≧Topc, it is expressed in formula (6).

$$TmY'=TmY'-Topc \quad (6)$$

Therefore, formula (7) is established.

$$0\leqq TmY'<Topc \quad (7)$$

Similarly, TmM' and TmC' are calculated.

Now, the phase correction set values TmY', TmM', and TmC' are stored in a nonvolatile memory.

On the other hand, when it is judged not necessary to detect the color deviation AC component, if the previous phase correction set values are valid, the phase correction set values TmY', TmM', and TmC' stored in the nonvolatile memory are read in.

From the present phase differences TmY, TmM, TmC, the phase correction amounts ΔTmY, ΔTmM, ΔTmC are calculated in the following formulas (8), (9), (10).

$$\Delta TmY=TmY'-TmY \quad (8)$$

$$\Delta TmM=TmM'-TmM \quad (9)$$

$$\Delta TmC=TmC'-TmC \quad (10)$$

In the phase correction control of photosensitive drum, the control for delaying the phase of the photosensitive drum home signal by lowering the rotating speed of the drive motors 5*y*, 5*m*, 5*c* of Y, M, C is explained below.

$$\text{If } \Delta TmY<0, \text{ then } \Delta TmY=\Delta TmY+Topc=TmY'-TmY+Topc \quad (11)$$

It is the same for ΔTmM and ΔTmC.

In the phase correction control of photosensitive drum, the control for advancing the phase of the photosensitive drum home signal by raising the rotating speed of the drive motors 5*y*, 5*m*, 5*c* of Y, M, C is explained below.

$$\text{If } \Delta TmY>0, \text{ then } \Delta TmY=\Delta TmY-Topc \quad (12)$$

It is the same for ΔTmM and ΔTmC.

Depending on the phase correction amount, it is judged whether to raise or lower the rotating speed of the drive motors 5*y*, 5*m*, 5*c* of Y, M, C, and the phase rotation of the photosensitive drum is controlled as follows in the direction of shortening the phase correction processing time.

$$\text{If } \Delta TmY<-Topc/2, \text{ then } \Delta TmY=\Delta TmY+Topc \quad (13)$$

$$\text{If } \Delta TmY>Topc/2, \text{ then } \Delta TmY=\Delta TmY-Top \quad (14)$$

It is the same for ΔTmM and ΔTmC.

Thus, the correction processing of home signals for phase correction is a half circumference of photosensitive drum at maximum, and it is possible to shorten the correction processing time (S8).

Referring now to FIG. 9, the phase correction control is described below.

In this embodiment, the phase of the photosensitive drum of K is not corrected, but other photosensitive drums Y, M, C are controlled to be adjusted to the phase of the photosensitive drum of K. It is assumed that all photosensitive drum drive motors 5*k*, 5*y*, 5*m*, 5*c* are driven at rotating speed Vs. First, the phase correction of photosensitive drum 6*y* of Y is explained. FIG. 9(*a*) shows control of deviating the phase of the photosensitive drum 6*y* of Y by ΔTmY by changing over the speed set value of the photosensitive drum drive motor 5*y* of Y from Vs to V1. At this time, the phase correction processing time takes nT.

In FIG. 9(*b*), the speed set value of the photosensitive drum drive motor 5*y* of Y is changed over by varying from Vs to V1, V2, . . . , V2, V1, Vs at every time T, so that the phase of the photosensitive drum 6*y* of Y is controlled to be deviated by ΔTmY, and the required processing time is mT (m≦n).

That is, by changing over the speed variable amount depending on the phase correction amount, the phase correction time can be shortened. This speed variable value differs every time depending on the phase correction amount, it may be prepared as a data table in the nonvolatile memory or RAM, which may be referred to as required.

It is the same for other photosensitive drum 6*m* of M and photosensitive drum 6*c* of C.

Thus, by correcting the phase of photosensitive drums of Y, M, C, the phase of AC components of color deviation of K, Y, M, C can be adjusted.

Thus, the embodiment comprises:

a) a plurality of drive motors 5*k*, 5*y*, 5*m*, 5*c* for driving a plurality of photosensitive drums 6*k*, 6*y*, 6*m*, 6*c* independently, b) a plurality of motor rotation controllers 4*k*, 4*y*, 4*m*, 4*c* for controlling rotation and driving of the plurality of drive motors 5*k*, 5*y*, 5*m*, 5*c* independently, c) a plurality of rotation phase detectors 7*k*, 7*y*, 7*m*, 7*c* for detecting the rotation phase of each one of the plurality of photosensitive drums 6*k*, 6*y*, 6*m*, 6*c* rotated and driven by the drive motors, d) a rotation phase difference calculator 3 for calculating the rotation phase difference of the other photosensitive drums 6*y*, 6*m*, 6*c* corresponding to the rotation phase of the specified photosensitive drum 6*k* as the reference among the rotation phases detected by the plurality of rotation phase detectors 7*k*, 7*y*, 7*m*, 7*c*, e) a phase correction setting unit 1 for setting the rotation phase difference in printing operation, and f) a phase correction controller 2 for correcting rotation phase of the photosensitive drums 6*y*, 6*m*, 6*c* on the basis of the calculated rotation phase difference and the set rotation phase difference.

Therefore, on the basis of the rotation phase difference of the photosensitive drums being calculated and the rotation phase difference of the photosensitive drums being set, the rotation phase of the photosensitive drums 6*y*, 6*m*, 6*c* can be corrected independently.

Hence, the rotation phase of the photosensitive drums 6*y*, 6*m*, 6*c* can be controlled precisely, and if there is position deviation of AC component in the sub-scanning direction, the position deviation is decreased, and deterioration of print quality can be prevented.

As described herein, the color image forming apparatus of the invention is capable of correcting the rotation phase of each photosensitive drum independently on the basis of the calculated rotation phase difference of photosensitive drums and the preset rotation phase difference of photosensitive drums. Therefore, the rotation phase of a plurality of photosensitive drums can be controlled precisely, and if there is position deviation of AC component in the sub-scanning direction, the position deviation is decreased, and deterioration of print quality can be prevented.

Also in the color image forming apparatus of the invention, the motor rotation controller controls the rotating speed of the drive motor by PLL control, and the phase correction controller controls the frequency of the PLL reference clock entered from the motor rotation controller. Therefore, by controlling the rotation phase of the photosensitive drum, the rotation phase of the photosensitive drum can be corrected accurately.

The color image forming apparatus of the invention further comprises a registration detector for detecting the registration pattern of each color formed in the plurality of image stations and sequentially transferred and conveyed to the transfer unit, and the phase correction setting unit sets the rotation phase difference by the correction value of the registration detected by the registration detector. Therefore, the phase correction controller can control the rotation phase of the plurality of photosensitive drums on the basis of the rotation phase difference calculated by the rotation phase difference calculator and the detected value of registration, and therefore the rotation phase of the plurality of photosensitive drums can be controlled precisely.

Further, the color image forming apparatus of the invention comprises an input setting unit for making various settings by the key input signal or external input signal, and the phase correction setting unit sets the rotation phase difference by the correction value set by the input setting unit. Therefore it is possible to control the rotation phase of the plurality of photosensitive drums precisely according to the user set value in the input setting unit.

In the color image forming apparatus of the invention, the phase correction controller controls the rotation phase correction of photosensitive drums before start of printing operation after exchange or adjustment of a plurality of images stations, after turning on the apparatus power source, or after jam treatment for removing paper jammed during printing operation.

Therefore, if the rotation phase is deviated in any one of the states above, it is possible to control so as to rotate at specified rotation phase by correcting the deviated rotation phase.

In the color image forming apparatus of the invention, in which a specific one of the plurality of photosensitive drums is a reference one, and the frequency of the PLL reference clock of the reference drive motor which is the drive motor for driving the photosensitive drum as reference is the reference frequency, the phase correction controller lowers the frequency of PLL reference clock of other drive motors with respect to the reference drive motor from the reference frequency only for a prescribed period. Thus, by controlling in the direction of delaying the rotation phase of the photosensitive drum, the phase of the photosensitive drums is corrected. Therefore, it is possible to control precisely when delaying the rotation phase of the photosensitive drums.

Similarly, in the color image forming apparatus of the invention, in which a specific one of the plurality of photosensitive drums is a reference one, and the frequency of the PLL reference clock of the reference drive motor which is the drive motor for driving the photosensitive drum as reference is the reference frequency, the phase correction controller raises the frequency of PLL reference clock of other drive motors with respect to the reference drive motor from the reference frequency only for a prescribed period. Thus, by controlling in the direction of advancing the rotation phase of the photosensitive drum, the phase of the photosensitive drums is corrected. Therefore, it is possible to control precisely when advancing the rotation phase of the photosensitive drums.

Also in the color image forming apparatus of the invention, in which a specific one of the plurality of photosensitive drums is a reference one, and the frequency of the PLL reference clock of the reference drive motor which is the drive motor for driving the photosensitive drum as reference is the reference frequency, the phase correction controller judges whether to raise or lower the frequency of PLL reference clock of other drive motors with respect to the reference drive motor from the reference frequency only for a prescribed period depending on the phase correction amount. By this judgement, the rotation phase of photosensitive drum is controlled in a direction of shortening the phase correction processing time, and the phase of the photosensitive drums is corrected. As a result, the processing time of rotation phase correction of the photosensitive drums is shortened, and the rotation phase can be controlled precisely.

Also in the color image forming apparatus of the invention, in which a specific one of the plurality of photosensitive drums is a reference one, and the frequency of the PLL reference clock of the reference drive motor which is the drive motor for driving the photosensitive drum as reference is the reference frequency, the phase correction controller controls the frequency of PLL reference clock of other drive motors with respect to the reference drive motor by contrast to reference frequency by changing over in several steps depending on the phase correction amount in a specific time unit for a prescribed period. By this changeover control, acceleration or deceleration of rotating speed of the drive motors is controlled, and the phase of photosensitive drum is corrected by controlling in a direction of shortening the phase correction processing time. As a result, the processing time of rotation phase correction of the photosensitive drums is shortened, and the rotation phase can be controlled precisely.

In the color image forming apparatus of the invention, the phase correction controller controls the frequency of reference clock of each PLL control, in a state of starting and rotating the individual drive motors by a reference clock which is reference for PLL control. Thus, while rotating the photosensitive drums driven by the drive motors, the rotation phase of the photosensitive drums can be controlled precisely.

Further in the color image forming apparatus of the invention, the phase correction setting unit stores the set values of the rotation phase difference in the nonvolatile memory. As a result, the number of times of processing for detection of registration patterns of colors can be curtailed, and also the process for re-designating the phase correction value can be saved.

What is claimed is:

1. A color image forming apparatus comprising:

a) a plurality of image stations including photosensitive drums and developing unit for developing the latent images formed on said photosensitive drums as toner images, b) a transfer unit for transferring and conveying the toner images formed in said plurality of image stations onto an intermediate transfer material, c) a plurality of exposure units for irradiating the individual photosensitive drums in said plurality of image stations with light for forming latent images, d) a plurality of drive motors for driving said plurality of photosensitive drums independently, e) a plurality of motor rotation controllers for controlling rotation and driving of said plurality of drive motors independently, f) a plurality of rotation phase detectors for detecting the rotation phase of each of said plurality of photosensitive drums rotated and driven by said drive motors, g) a rotation phase difference calculator for calculating the rotation phase difference of other photosensitive drums corresponding to the rotation phase of a specified photosensitive drum as a reference among the rotation phases detected by said plurality of rotation phase detectors, h) a phase correction setting unit for setting said rotation phase difference of said other photosensitive drums in a printing operation, and i) a phase correction controller for correcting rotation phase of said other photosensitive drums on the basis of said calculated rotation phase difference and said set rotation phase difference, wherein said rotation phase is corrected in steps depending on a phase correction amount set for each step.

2. The color image forming apparatus of claim 1, wherein said motor rotation controller controls the rotation phase of said photosensitive drums by controlling the rotating speed of said drive motor by phase locked loop control, and said phase correction controller controls the frequency of the phase locked loop reference clock entered from the motor rotation controller.

3. The color image forming apparatus of claim 1, further comprising a registration detector for detecting the registration pattern of each color formed in said plurality of image stations and sequentially transferred and conveyed to said transfer unit, wherein said phase correction setting unit sets said rotation phase difference by the correction value of the registration detected by said registration detector.

4. The color image forming apparatus of claim 1, further comprising an input setting unit for making various settings by the key input signal or external input signal, wherein said phase correction setting unit sets said rotation phase difference by the correction value set by said input setting unit.

5. The color image forming apparatus of claim 1, wherein said phase correction controller controls the rotation phase correction of said photosensitive drums before start of printing operation, after exchange or adjustment of said plurality of images stations, after turning on the apparatus power source, or after jam treatment for removing paper jammed during printing operation.

6. The color image forming apparatus of claim 1, wherein, assuming that a specific one of said plurality of photosensitive drums is a reference one, and that the frequency of a phase locked loop reference clock of the reference drive motor which is the drive motor for driving said photosensitive drum as reference is the reference frequency, said phase correction controller lowers the frequency of the phase locked loop reference clock of other drive motors with respect to said reference drive motor from said reference frequency only for a prescribed period, thereby controlling in the direction of delaying the rotation phase of said photosensitive drum, so that the phase of said photosensitive drums is corrected.

7. The color image forming apparatus of claim 1, wherein, assuming that a specific one of said plurality of photosensitive drums is a reference one, and that the frequency of a phase locked loop reference clock of the reference drive motor which is the drive motor for driving said photosensitive drum as reference is the reference frequency, said phase correction controller raises the frequency of the phase locked loop reference clock of other drive motors with respect to said reference drive motor from said reference frequency only for a prescribed period, thereby controlling in the direction of advancing the rotation phase of said photosensitive drum, so that the phase of said photosensitive drums is corrected.

8. The color image forming apparatus of claim 1, wherein, assuming that a specific one of said plurality of photosensitive drums is a reference, and that the frequency of a phase locked loop reference clock of the reference drive motor, which is the drive motor for driving said photosensitive drum as reference, is the reference frequency, said phase correction controller judges whether to raise or lower the frequency of the phase locked loop reference clock of other drive motors with respect to said reference drive motor from said reference frequency only for a prescribed period depending on the phase correction amount, thereby controlling the rotation phase of said photosensitive drum in a direction of shortening the phase correction processing time, so that the phase of the photosensitive drums is corrected.

9. The color image forming apparatus of claim 1, wherein, assuming that a specific one of said plurality of photosensitive drums is a reference, and that the frequency of a phase locked loop reference clock of the reference drive motor, which is the drive motor for driving said photosensitive drum as the reference, is the reference frequency, said phase correction controller controls the frequency of the phase locked loop reference clock of other drive motors with respect to said reference drive motor by contrast to reference frequency by changing over in several steps depending on the phase correction amount in a specific time unit for a prescribed period, thereby controlling acceleration or deceleration of rotating speed of the drive motors, so that the phase of said photosensitive drums is corrected by controlling in a direction of shortening the phase correction processing time.

10. The color image forming apparatus of claim 1, wherein said phase correction controller controls the frequency of a reference clock of a phase locked loop control, in a state of starting and rotating the individual drive motors by a reference clock which is reference for the phase locked loop control, and thereby the phase of said photosensitive drums is corrected.

11. The color image forming apparatus of claim 1, wherein said phase correction setting unit stores the set values of said rotation phase difference in a nonvolatile memory rotation phase difference.

12. A color image forming apparatus comprising:

a) a plurality of image stations including photosensitive drums and developing unit for developing the latent images formed on said photosensitive drums as toner images, b) a transfer unit for transferring and conveying the toner images formed in said plurality of image stations onto an intermediate transfer material, c) a plurality of exposure units for irradiating the individual photosensitive drums in said plurality of image stations with light for forming latent images, d) a plurality of drive motors for driving said plurality of photosensitive drums independently, e) a plurality of motor rotation controllers for controlling rotation and driving of said plurality of drive motors independently, f) a plurality of rotation phase detectors for detecting the rotation phase of each of said plurality of photosensitive drums rotated and driven by said drive motors, g) a rotation phase difference calculator for calculating the rotation phase difference of other photosensitive drums corresponding to the rotation phase of a specified photosensitive drum as a reference among the rotation phases detected by said plurality of rotation phase detectors, h) a phase correction setting unit for setting said rotation phase difference in a printing operation, and i) a phase correction controller for correcting rotation phase of said photosensitive drums on the basis of said calculated rotation phase difference and said set rotation phase difference, wherein, assuming that a specific one of said plurality of photosensitive drums is a reference, and that the frequency of a phase locked loop reference clock of the reference drive motor, which is the drive motor for driving said photosensitive drum as the reference, is the reference frequency, said phase correction controller controls the frequency of the phase locked loop reference clock of other drive motors with respect to said reference drive motor by contrast to reference frequency by changing over in several steps depending on the phase correction amount in a specific time unit for a prescribed period, thereby controlling acceleration or deceleration of rotating speed of the drive motors, so that the phase of said photosensitive drums is corrected by controlling in a direction of shortening the phase correction processing time.

* * * * *